US005271327A

United States Patent [19]

Filo et al.

[11] Patent Number: 5,271,327

[45] Date of Patent: Dec. 21, 1993

[54] ELECRO-MECHANICAL BASE ELEMENT FUZE

[75] Inventors: Gregory F. Filo, Rogers; Dennis L. Kurschner, Minnetonka; Paul L. Weber, Eden Prairie, all of Minn.

[73] Assignee: Alliant Techsystems Inc., Edina, Minn.

[21] Appl. No.: 901,381

[22] Filed: Jun. 19, 1992

[51] Int. Cl.[5] ..... F42C 11/00; F42C 19/12

[52] U.S. Cl. ..... 102/207; 102/202.5; 102/247

[58] Field of Search ..... 102/207, 208, 247, 251, 102/221, 200, 202.5

[56] References Cited

U.S. PATENT DOCUMENTS

| | | | |
|---|---|---|---|
| 2,682,567 | 6/1954 | Porter | 102/207 |
| 2,931,848 | 4/1960 | Burrell | 102/207 |
| 3,417,700 | 12/1968 | Furlani | 102/70.2 |
| 4,080,869 | 3/1978 | Karayannis et al. | 89/6.5 |
| 4,119,038 | 10/1978 | Allen et al. | 102/207 |
| 4,128,061 | 12/1978 | Kaiser | 102/249 |
| 4,449,457 | 5/1984 | Haissig | 102/251 |
| 4,464,991 | 8/1984 | Kaiser | 102/233 |
| 4,603,635 | 8/1986 | Boudreau | 102/206 |
| 4,691,634 | 9/1987 | Titus et al. | 102/245 |
| 4,796,532 | 1/1989 | Webb | 102/233 |
| 4,831,932 | 5/1989 | Bayerkohler et al. | 102/202.5 |
| 4,876,960 | 10/1989 | Schillinger et al. | 102/249 |
| 4,955,279 | 9/1990 | Nahrwold | 89/6.5 |
| 4,969,397 | 11/1990 | Gunther et al. | 102/233 |
| 4,995,317 | 2/1991 | Bankel et al. | 102/235 |
| 5,078,051 | 1/1992 | Amundson | 102/206 |
| 5,147,973 | 9/1992 | Ziemba | 102/207 |

OTHER PUBLICATIONS

Alliant Technology, "Introduction of the XM744 Fuze".

Alliant Technology, "Military Specification: Fuze, PIBD, XM740, Second Environment Sensor For" (1984).

Campagnuolo et al., "Induction Sensor to Provide Second Environmental Signature for Safing and Arming a Non-spin-Projectile Fuze" (1984).

*Primary Examiner*—David H. Brown

*Attorney, Agent, or Firm*—Merchant, Gould, Smith, Edell, Welter & Schmidt

[57] ABSTRACT

An electro-mechanical base element fuze is disclosed wherein mechanical innovations along with the latest in electronic sensing, signal processing and miniaturization provide safety and simplicity as well as improving performance, reliability and reducing costs.

21 Claims, 13 Drawing Sheets

ELECRO-MECHANICAL BASE ELEMENT FUZE

BACKGROUND OF THE INVENTION

1. Field of the Invention

This invention relates in general to large caliber projectiles employing warheads, and in particular, to a fuze for an explosive projectile which incorporates electronic sensing, signal processing and miniaturization.

2. Description of Related Art

A munitions fuze must provide proper weapon system operation as well as be reliable in order to safely manufacture, store and use. Generally, the fuze must insure that there is no possibility of main warhead initiation until the munition is actually on its way to the target. Several United States military standards (Mil-Stds) have been adopted, such as 1316D, to provide top level guidance for design safety.

Existing fuzes for large caliber explosive projectiles are virtually entirely mechanical in nature, exhibiting the state of technology of the 1950s and 1960s. An example of a commonly employed base element fuze presently used in such projectiles is the fuze designated as the "M774" manufactured by the Bulova/Systems and Instruments Corporation of Valley Stream, N.Y. The M774 fuze contains over 150 parts, many having exacting tolerances which are critical to reliable operation. The large number of parts and the small tolerances lead to high costs, poor reliability, and inadequate second sourcing.

The newest fuze technology, electronic safe and arm (ESA), is at the opposite end of the spectrum from the XM774. This technology exhibits no moving parts with all functions performed electronically.

One of the major drawbacks of fuzes utilizing all electronic components as found in ESA devices, however, is that the devices can only tolerate limited acceleration rates. Another major limitation is that the required electronics consume much needed space. Therefore, previous efforts have been directed to those environments having lower acceleration forces and having flexible available volumes for electronics. The most widely used application of ESA is in self-propelled missiles such as a "cruise" missile. In this type of application, acceleration rates reach about a maximum of 100 times the Earth's normal gravitational force (hereafter referred "G's").

In contrast, a projectile launched from a tank exhibits acceleration rates in excess of 50,000 G's. These high acceleration forces have made extensive use of electronics unrealizable or at least impracticable in tank launched projectiles. Compounding the problem of electronics in tank launched and similar projectiles is the limited packaging volume available.

The leap between all mechanical and all electronic design approaches is considerably different both philosophically and functionally. In fact, Mil-Std 1316C has been rewritten as Mil-Std 1316D to try to accommodate ESA technology. Users and manufacturers are currently forced to live with or to modify outdated products or to wait for maturation of the new technology which is developing slowly.

It can be seen then that an improved fuze is needed that fills the void between existing all mechanical fuzes having their drawbacks and the developing ESA technology.

SUMMARY OF THE INVENTION

To overcome the limitations in the prior art described above, and to overcome other limitations that will become apparent upon reading and understanding the present specification, the present invention discloses an electromechanical base element fuze for use in explosive projectiles. The invention bridges the gap between existing technology and developing future products in the munitions fuze area. The present base element fuze provides sensing of first and second launch related environments for safety and electronically determining a safe separation prior to arming the projectile.

As noted above, the present invention is useful in high G force environments—such as in explosive projectiles fired from tanks. However, it should be apparent to those skilled in the art upon a reading of the present specification that the invention is also applicable to other environments. Therefore, while the tank example will be discussed herein, the present invention is not so limited, and various aspects may be applied to large artillery and rocket style munition fuze applications.

In a preferred embodiment constructed according to the principles of the present invention, the fuze includes three major components which will next be described. First, a reserve battery assembly is arranged and configured within the base fuze. The assembly has a proximal end and a distal end, with a reservoir cooperatively located at the distal end. A voltage producing cell stack surrounds the reservoir and a mass is slidably disposed in a first position at the proximal end. The reservoir contains an electrolyte separate from the voltage producing cell stack. Upon launch of the projectile, acceleration forces in the opposite direction of the intended flight path of the projectile are applied to the mass (i.e., as the projectile is accelerated from the breech to the muzzle during firing, the mass tends to remain at rest relative to the projectile and in order to accelerate the mass a force must be applied to the mass). Accordingly, the mass slidably moves from the proximal end toward the distal end until it comes into contact with the reservoir. However, the forces required to accelerate the mass rupture the reservoir. The electrolyte then escapes into the cell stack providing battery voltage within the first several milliseconds of motion.

Second, the fuze includes a safe and arm assembly for safely arming the projectile and later initiating the explosion. Fuze safety also includes a rotor having a bore hole formed therein which selectively interrupts the initiating explosive train. The explosive interface between the detonator and the lead is unimpeded when the bore hole is in-line with a second corresponding hole in a protective cover. The rotor is normally secured by a setback lock. Upon firing, an in-bore lock (in conjunction with a retaining collar) moves down at a low acceleration level to additionally secure the rotor out-of-line while the projectile is in the gun tube. The movement of the in-bore lock also removes an impact drive surface for a piston actuator on the rotor, which eliminates the possibility of an in-bore-arming in the event of an inadvertent firing of the piston actuator.

During the period in the gun tube, the setback lock also swings down under a predetermined high acceleration and causes the setback lock to latch, leaving only the in-bore lock and a shear/break-away tab holding the rotor. Once out of the gun tube, the in-bore lock releases, leaving the rotor free (except for the shear tab which is overcome by the piston actuator) and restoring the impact drive surface of the piston actuator on the rotor. The electrically activated piston actuator is positioned to rotate and lock the rotor in line such that the bore holes in the rotor and cover are aligned for target initiated detonation. The piston actuator is controlled by an electronics assembly.

Third, the fuze includes an electronics assembly for providing control of the fuze. The electronics performs executive control of the fuze including environment sensing, timing, sequencing, and logical checks. The electronics assembly further preferably includes a second environment sensor, dual safe arming and firing logic, system timing, a power supply for conditioning and regulating the voltage from the battery assembly, a battery drain circuit for draining the battery in the event that the battery is activated but a second environment event does not occur, fire switches for firing a detonator and a piston actuator respectively, and a short monitor for monitoring a firing line input to ensure that a fire signal to the detonator fire circuit is impeded prior to its intended time of function.

In a preferred embodiment in accordance with the present invention, the second environment sensor detects the release of the sabot petals after the projectile has left the gun tube and traveled a few meters. Preferably, magnetic detection means are utilized which not only provide an out-of-bore environment check, but simultaneously provide a signal from which further fuze functions can be based. Therefore, the electronic second environment sensor increases reliability while the electronic timing and control of the fuze provides precise control of the time at which the projectile is armed.

As noted above, the preferred embodiment is intended to operate in a system environment having a setback acceleration in excess of 55,000 G's and a temperature range from $-25°$ to $+140°$. Further, the preferred embodiment is operable in a projectile having little or no spin, an in-bore time ranging from 8 to 12 milliseconds and a free flight time up to 8 seconds.

One feature of the preferred embodiment constructed in accordance with the principles of the present invention is a safe and arm (S&A) mechanism having an electro-mechanical out-of-line safety for providing first environment safety, preventing in-bore arming, providing a high order initiation of a booster, and significantly lowering parts count over existing fuze systems. A piston actuator properly breaks a shear tab and turns the rotor about its axis to arm the projectile so that there is a significant reduction in parts count in the S&A, thus reducing cost.

A setback lock is provided for inhibiting rotary movement of the rotor until first environment setback acceleration occurs. The impact drive surface of the rotor is not available as a target area to the piston actuator until the in-bore lock has been returned to the arm enable position subsequent to bore exit. Therefore, inadvertent firing of the piston actuator prior to a first environment occurrence does not arm the projectile. In tests, it has been determined that the preferred S&A can be dropped 40 feet without latching the setback lock. However, the setback lock successfully latches under sustained acceleration on the order of 20,000 G's.

A second feature of the preferred embodiment is a rapid rise reserve battery which replaces the typical setback generator and an externally located and inconvenient thermal reserve battery of current systems. The battery is initiated by setback acceleration for powering the fuze subsystems. The battery voltage rise time is less than 5 milliseconds for initial signal processing and less than 25 milliseconds to full thermal output voltage (30 volts).

Therefore, according to one aspect of the invention, the new fuze technology improves existing tank projectile performance serving present, as well as future projectile systems.

In another aspect of the invention, systems and methods are disclosed which increase reliability and reduce costs while satisfying requirement objectives for future work with precision armaments.

In another aspect of the invention, a base element fuze is disclosed having a modular form factor and including technology applicable to a wide variety of existing and future precision armaments. The modular form factor design allows independent utilization of the various subsystems in accordance with the present invention. The subsystems which are normally used in conjunction with each other can be used independently so as to be adapted for a variety of applications.

In another aspect of the invention, a base element fuze providing at least two independent safety features to prevent premature arming is disclosed.

Another aspect of the invention is that it includes an internal reserve battery for providing power for all fuze system functions including elements disposed in the nose of the projectile.

Another aspect of the invention is that it responds to provides hard target and proximity sensor signals as well as a trembler switch signal for soft target impact.

The electronic timing and control subsystem disclosed herein allows for a plurality of inputs such as, but not limited to, first and second environment sensors for determination of proper detonation of the warhead. The electronic subsystem comprises electronics circuitry having industrial grade plastic packages, the entire circuits being potted with a suitable potting compound, such that acceleration forces in excess of 50,000 G's can be sustained without electronic component failure.

These and various other advantages and features of novelty which characterize the invention are pointed out with particularity in the claims annexed hereto and forming a part hereof. However, for a better understanding of the invention, its advantages, and the objects obtained by its use, reference should be made to the drawing which forms a further part hereof, and to the accompanying descriptive matter, in which there is illustrated and described specific examples of devices and methods in accordance with the invention.

BRIEF DESCRIPTION OF THE DRAWING

In the drawing, wherein like reference numerals and letters indicate corresponding elements throughout the several views.

DESCRIPTION OF THE PREFERRED EMBODIMENT

In the following description of the preferred embodiment reference is made to the accompanying drawing which forms a part hereof, and in which is shown by way of illustration a specific embodiment in which the invention may be practiced. It is to be understood that other embodiments may be utilized and structural changes may be made without departing from the scope of the present invention.

Figure 1A:
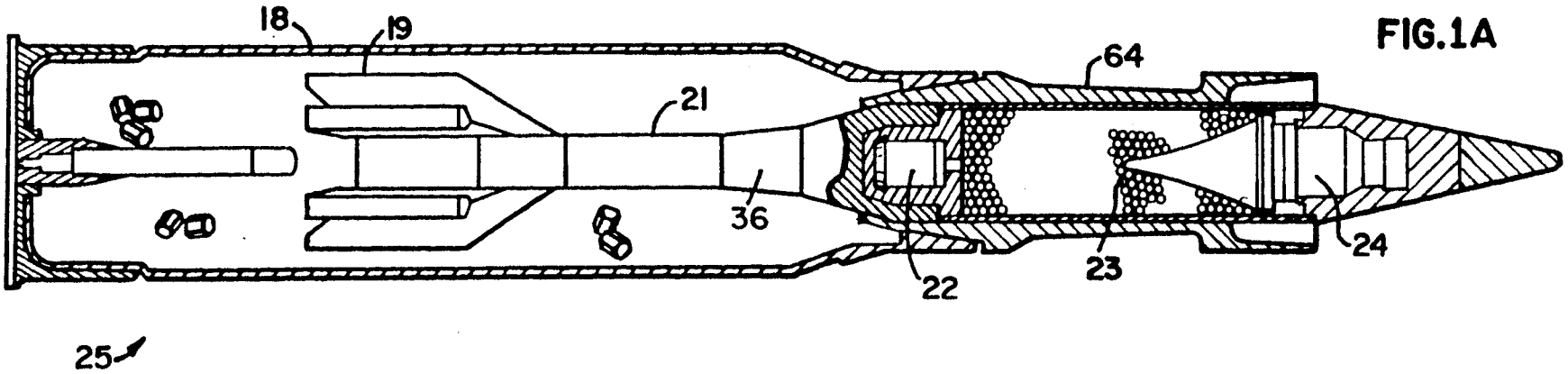
FIGS. 1A, 1B and 1C depict a projectile having a base element fuze in accordance to the principles of the present invention.
Figure 1C:
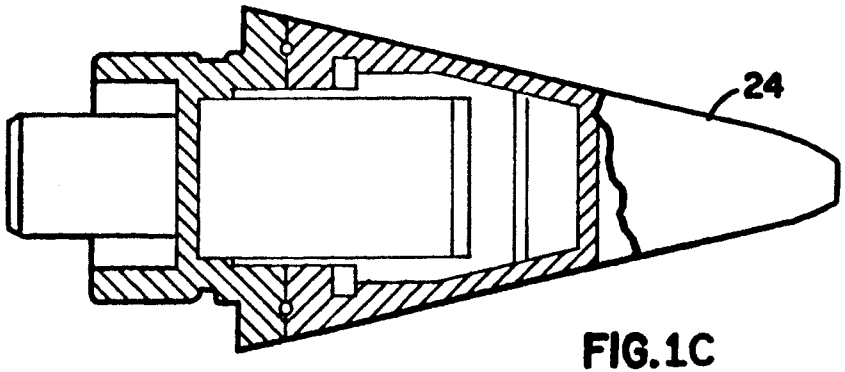
Figure 1B:
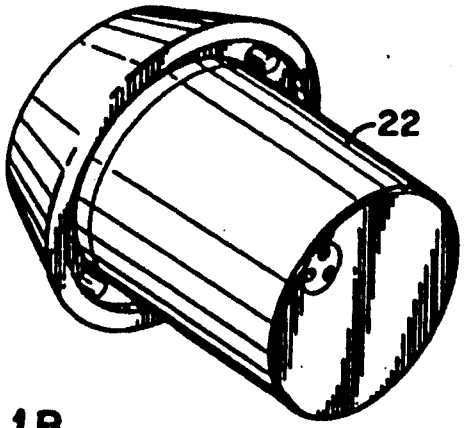

Reference is now made to FIGS. 1A, 1B and 1C which depicts an explosive projectile (hereafter referred to as a "projectile") having a base element fuze in accordance with the principles of the present invention. The projectile is illustrated generally at 15. In the preferred embodiment, the projectile 15 is depicted as a 120 mm tank round manufactured by Alliant Techsystems Inc. of Minneapolis Minn., having a designation of M830A1. Those skilled in the art will be able to bring to mind other suitable large caliber munitions devices for which the principles of the present invention may be suitable and/or practiced.

The projectile 15 is mounted in a cartridge 18 for insertion into a launch tube such as a tank barrel (i.e., the breech end of the bore of a tank gun). The projectile 15 comprises a fin and tracer assembly 19 coupled through a fin adapter 21 to a body 23 containing a base element assembly 22. A sabot 64, described in more detail herein below, shrouds the projectile 15 to prevent propellant gases from escaping around the projectile 15 during firing and to assist acceleration of the projectile 15 down the tube. At the frontal portion of the projectile 15 is disposed a nose cone 24 containing, inter alia, impact and proximity sensors described in more detail herein below.

Figure 2:
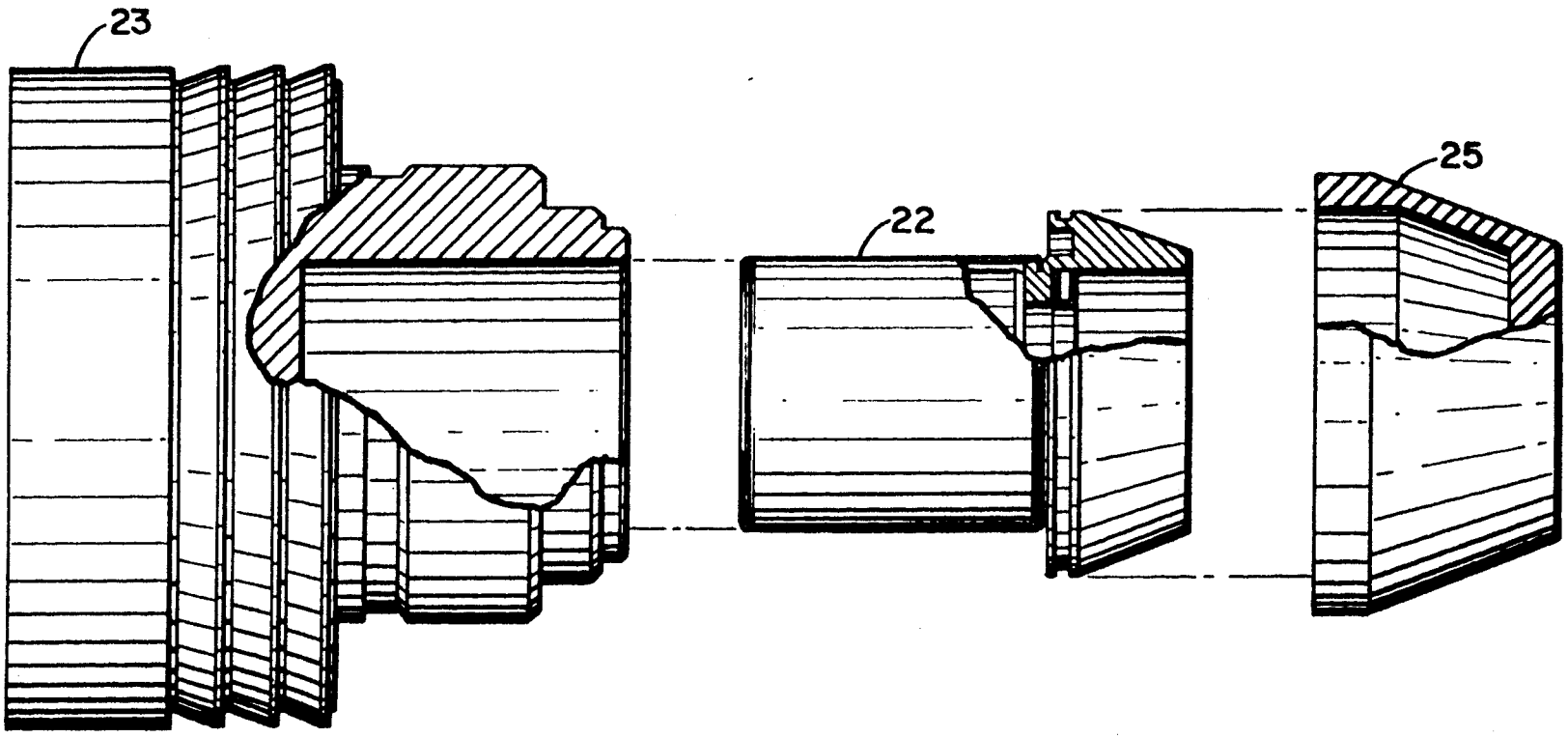
FIG. 2 is an exploded cut away side view depicting the base element fuze coupling to a body of a round and to an end cap.
Figure 3:
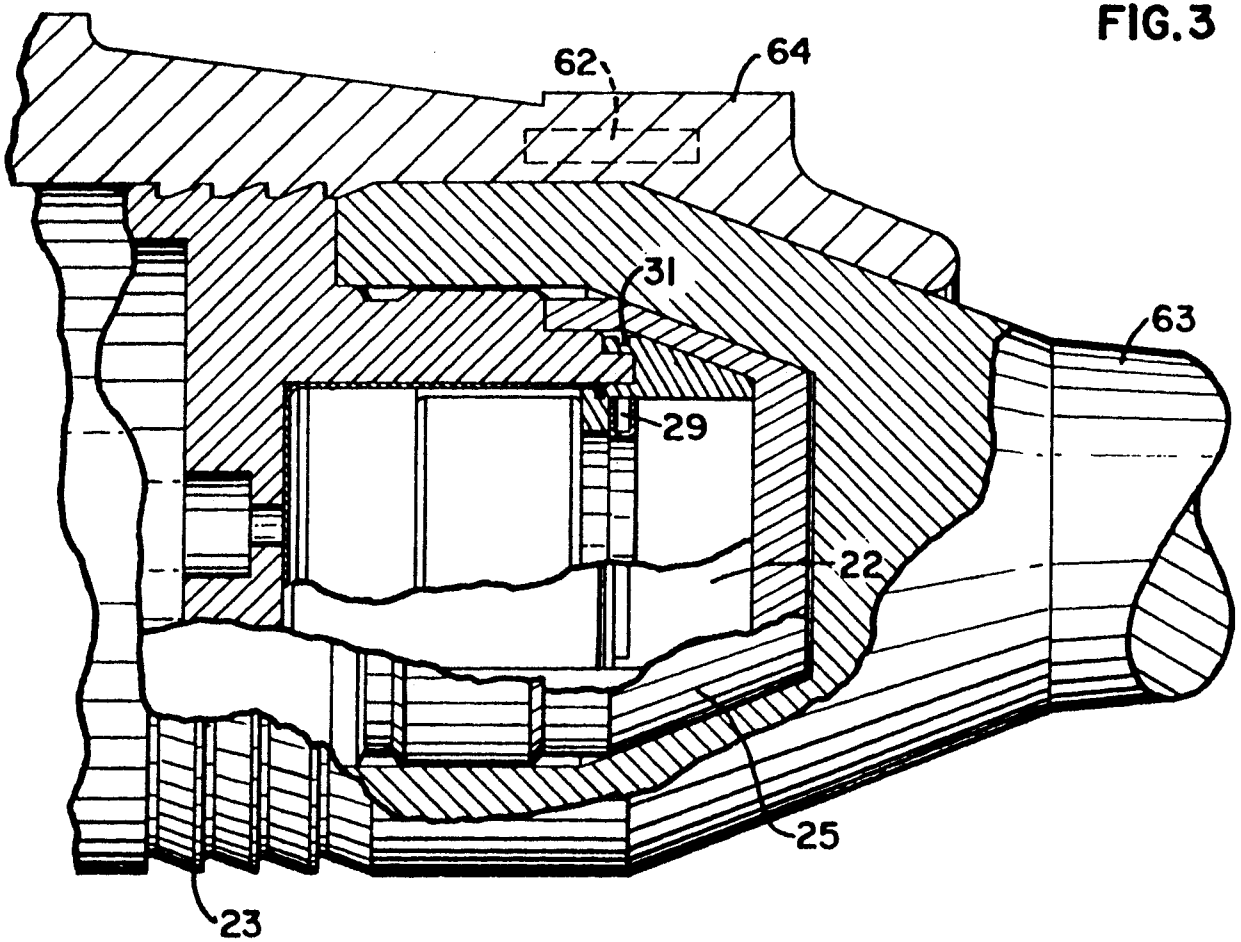
FIG. 3 is a more detailed cut away view of the body of the round depicted in FIG. 2.

Reference is now made to FIGS. 2 and 3 which depict a cut away side view of the base element 22 coupling to a body of a round 23 and to an end cap 25. More specifically, FIG. 3 depicts a cut away view of the projectile 15 having a tail boom 63 in assembled form. As best seen in FIG. 3, a sabot magnet 62 is embedded in the sabot 64. Inner and outer sensor coils 29 and 31 within the base element fuze 22 are positioned to detect the magnetic field change generated when each sabot 64 (and therefore the magnet 62) fly off the projectile 15 upon exit from the muzzle of the tank gun (not shown). The magnet and sensor coil combination is said to be a second environment sensor subsystem described in more detail herein below.

Figure 4:
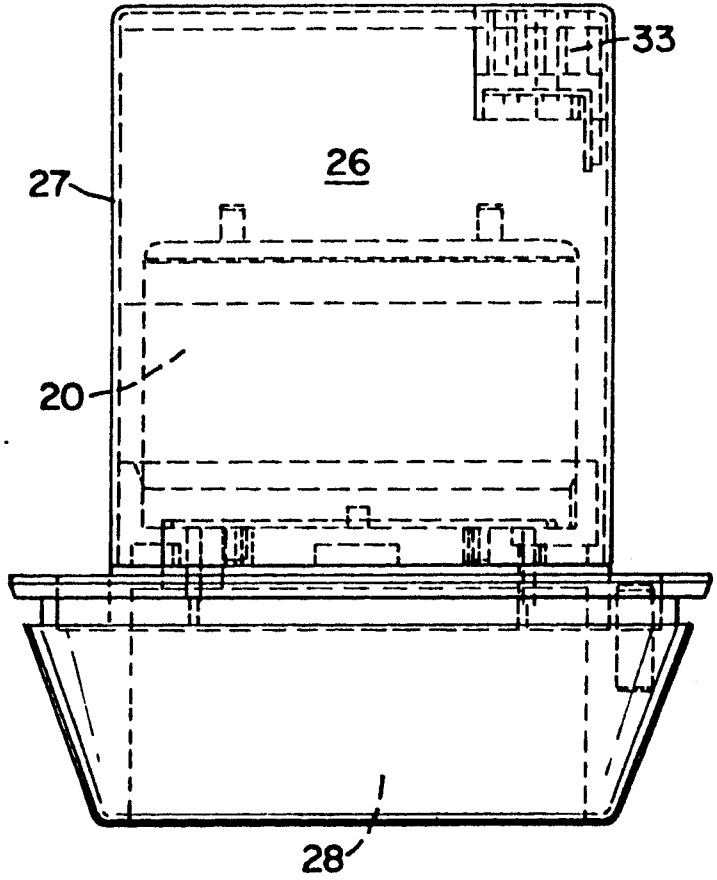
FIG. 4 depicts the form factor of the base element fuze in more detail and the location of the subassemblies within the fuze.
Figure 5:
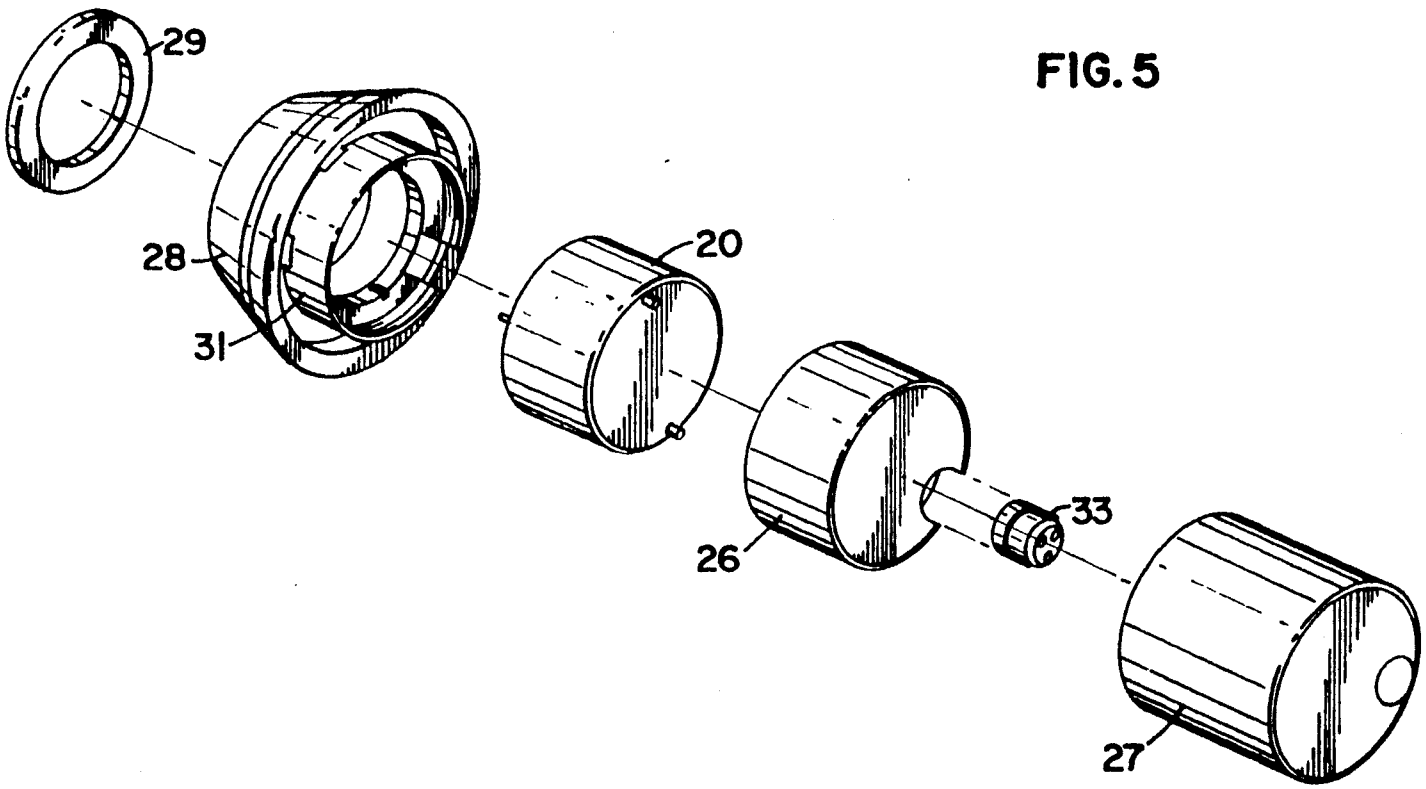
FIG. 5 is an exploded view of the base element fuze.

Reference is now made to FIGS. 4 and 5 which depict the form factor of the base element assembly 22 in more detail and the location of the subassemblies therein.

The base element assembly 22 comprises a case 27 which houses a battery assembly 20, a safe and arm assembly 26, electronic assembly 28, connector 33, and inner and outer sensor coils 29 and 31.

Figure 6:
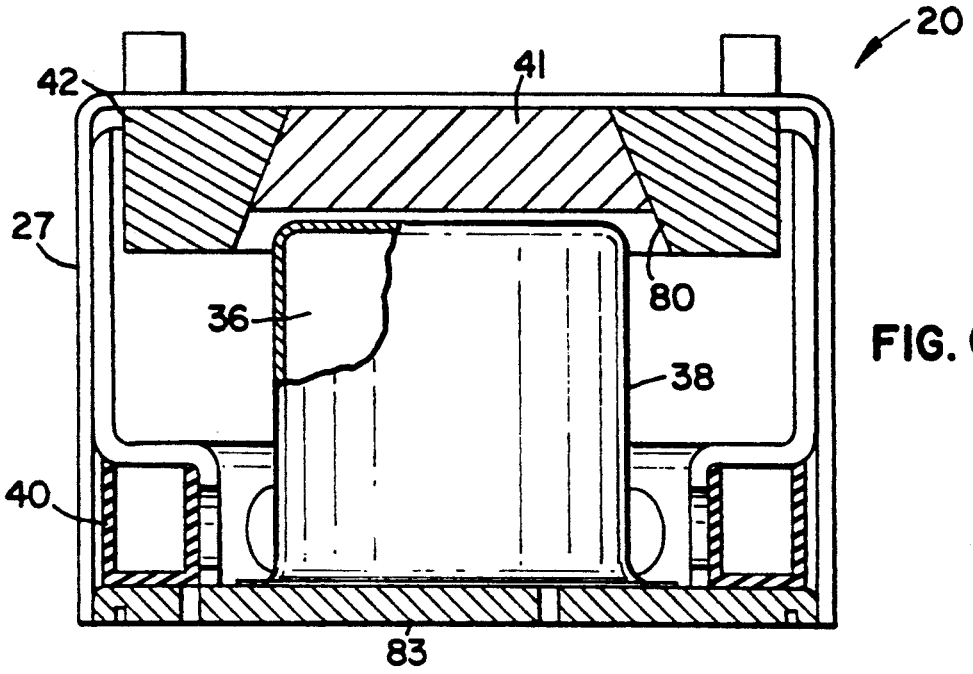
FIG. 6 is a side view of the battery in accordance with the teachings of the present invention.

Reference is now made to the reserve battery assembly 20 depicted in FIG. 6. The battery assembly 20 is characterized by the electrolyte 36 stored in a reservoir 38 separate from voltage producing cell stack 40. The reserve nature of the battery assembly 20 allows for extreme storage in excess of twenty years (which may be a required specification for projectile applications). Upon launch of the projectile 15, inner and outer drive disks 41 and 42 slidably positioned proximate the reservoir 38 inside the battery assembly 20 are moved by the acceleration forces from a first static position to a second operative position. In doing so, the reservoir 38 is crushed and the liquid electrolyte 36 is forced into the cell stack area 40 producing nearly instantaneous (within several milliseconds of first motion) cell voltage and subsequent battery voltage. The outer drive disk 42 is coated with Teflon (R) to reduce the friction between the disk and the case 27.

Outer disk 42 is "donut" shaped with a tapered center opening 80 (best seen in FIG. 6). Inner disk 41 is a solid disk which is chamfered to fit within tapered opening 80.

Figure 7A:
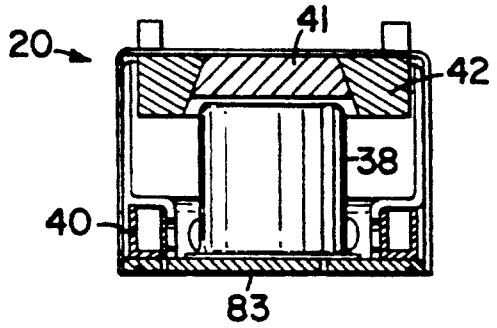
FIGS. 7A, 7B, and 7C illustrate the battery depicted in FIG. 6 at three stages during setback acceleration.
Figure 7B:
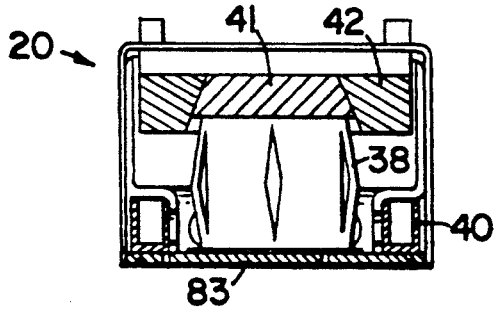
Figure 7C:
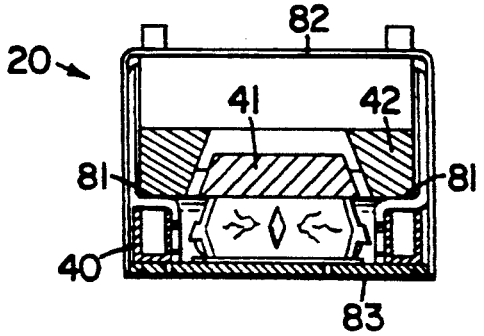

FIGS. 7A, 7B and 7C depict the battery 20 in three stages namely inactivated (first static position best seen in FIG 7A), partially activated (start of setback acceleration best seen in FIG. 7B), and fully activated (second operative position best seen in FIG. 7C). In essence, the forces on the inner and outer drive disks 41 and 42 crush reservoir 38 during setback acceleration, thereby allowing the liquid electrolyte 36 to be forced into the cell stack area 40. In the third stage, it can be seen that the outer disk 42 comes to rest against shoulders 81, while inner disk 41 continues to move from the proximal end 82 to the distal end 83 so as to completely crush the reservoir 38 and force the electrolyte into the cell stack area 40. With the reservoir 38 crushed and battery voltage available, both mechanical and electrical functions occur in the fuze as the projectile 15 moves through its launch and mission life cycle.

Figure 8:
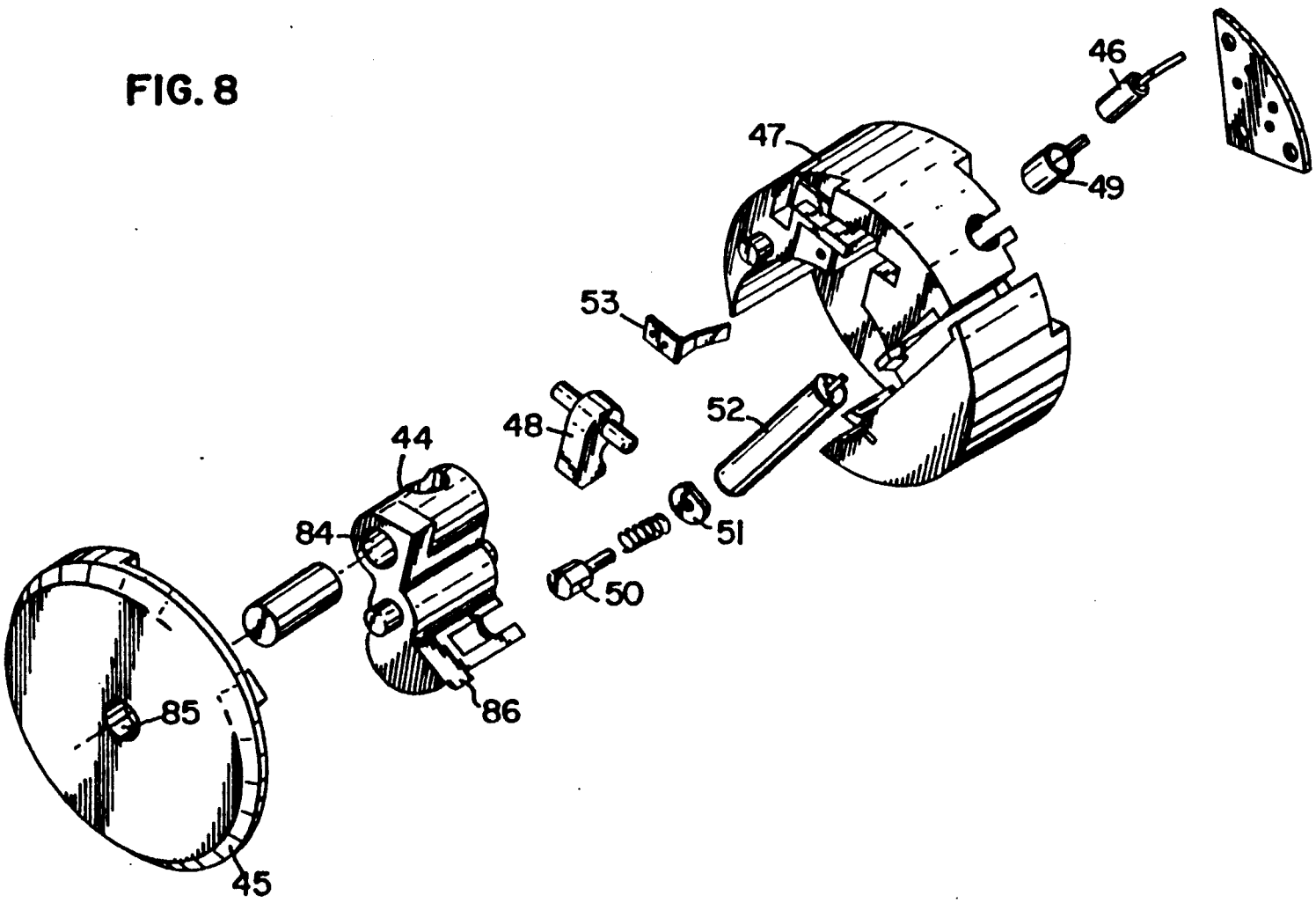
FIG. 8 is an exploded view of the safe and arm assembly and related components.

Reference is now made to FIG. 8 which depicts the S&A assembly 26 in exploded view. Fuze safety is produced by a rotor 44 having a bore hole 84 defined therein which interrupts the explosive train between the detonator 46 (secured in S&A housing 47 by ground clip 49). The explosive train between the detonator 46 and the lead 43 (FIG. 10) is unimpeded when the bore hole in rotor 44 is in line with the cover bore hole 85 in cover 45. The rotor 44 is held by a setback lock 48. The rotor may be considered to have two positions. The first position occurs when the explosive train is not in-line. Therefore, the first position defines the safe position. The second position defines the armed position.

Upon gun launch, an in-bore lock 50 in conjunction with retaining collar 51 moves down at the initial lower acceleration level to secure the rotor 44 out-of-line while the projectile 15 is within the gun tube (i.e., the rotor is locked in its first position). The movement of the in-bore lock 50 also removes the impact drive surface of the rotor 44 for the piston actuator 52. This eliminates the possibility of arming the projectile 15 while in-bore in the event of an inadvertent firing of piston actuator 52. At sustained acceleration, the setback lock 48 swings down and causes setback latch 53 to latch, leaving only the in-bore lock 50 and the shear tab 86 holding the rotor 44. Once out of the gun tube, the in-bore lock 50 is returned to the arm enable position by a long compression spring and restores the impact drive surface of piston actuator 52 on the rotor 44. The final function required to arm the fuze is produced by the electrically activated piston actuator 52. Firing the piston actuator causes rotor 44 to rotate about its axis. A pawl spring locks the rotor with the explosive train in-line through bore holes 84, 85 in the rotor 44 and cover 45 for target initiated detonation. The piston actuator 52 is controlled by the electronics assembly 28 described in more detail herein below.

Figure 9:
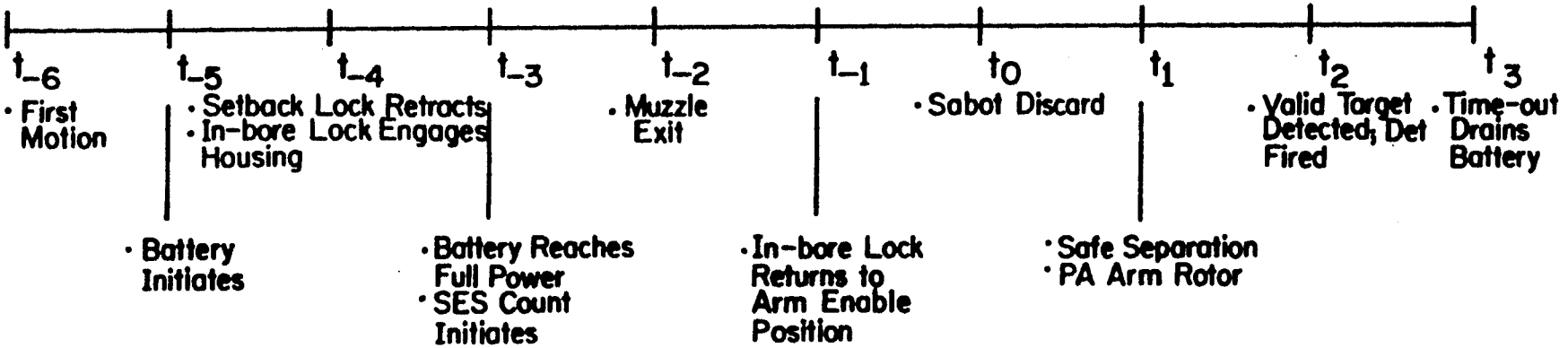
FIG. 9 is a time line depicting the temporal relationship of events in the present invention.

Reference is made now to FIG. 9 which depicts the temporal occurrences of major events in the present invention. First motion occurs at time $t_{-6}$ which causes the battery 20 to initiate at time $t_{-5}$. After the battery initiates at $t_{-5}$ the functions in the S&A assembly 26 begin to occur. At time $t_{-4}$ the setback lock 48 retracts and the in-bore lock 50 engages the S&A housing 47. At time $t_{-3}$ (typically less than 5 milliseconds) the battery 20 reaches sufficient power to turn on low-voltage electronics and a first timer is initiated for detecting a second environment condition (discussed below in more detail). In the preferred embodiment, the first timer is started to window the release of the sabot 64 which should occur at time $t_0$. However, other suitable events for second environment conditions might also be used. At time $t_{-2}$ (typically on the order of 8 milliseconds) the projectile 15 exits the muzzle. At time $t_{-1}$ the in-bore lock 50 releases leaving the rotor 44 free (except for the shear tab) and restoring the impact drive surface of piston actuator 52 on the rotor 44. At time $t_0$ (typically 9–14 milliseconds from launch initiation) the sabot 64 is discarded triggering the second environment condition. If the second environment event occurs before the first timer expires, a second timer is initiated to generate a safe separation time. The safe separation time is the point at which the projectile 15 will actually arm (i.e., the rotor moves to its second position bringing the explosion train in-line) provided all fuze functions (i.e., acceleration environments, sabot release, timing, etc.) occur correctly. At time $t_1$, the safe separation distance, the piston actuator 52 fires and the rotor 44 is locked in-line thereby arming the projectile 15. At time $t_2$ a valid target is detected and the detonator is fired. At time $t_3$, the maximum mission timeout occurs if a valid target is not detected and the battery 20 is drained.

Figure 10:
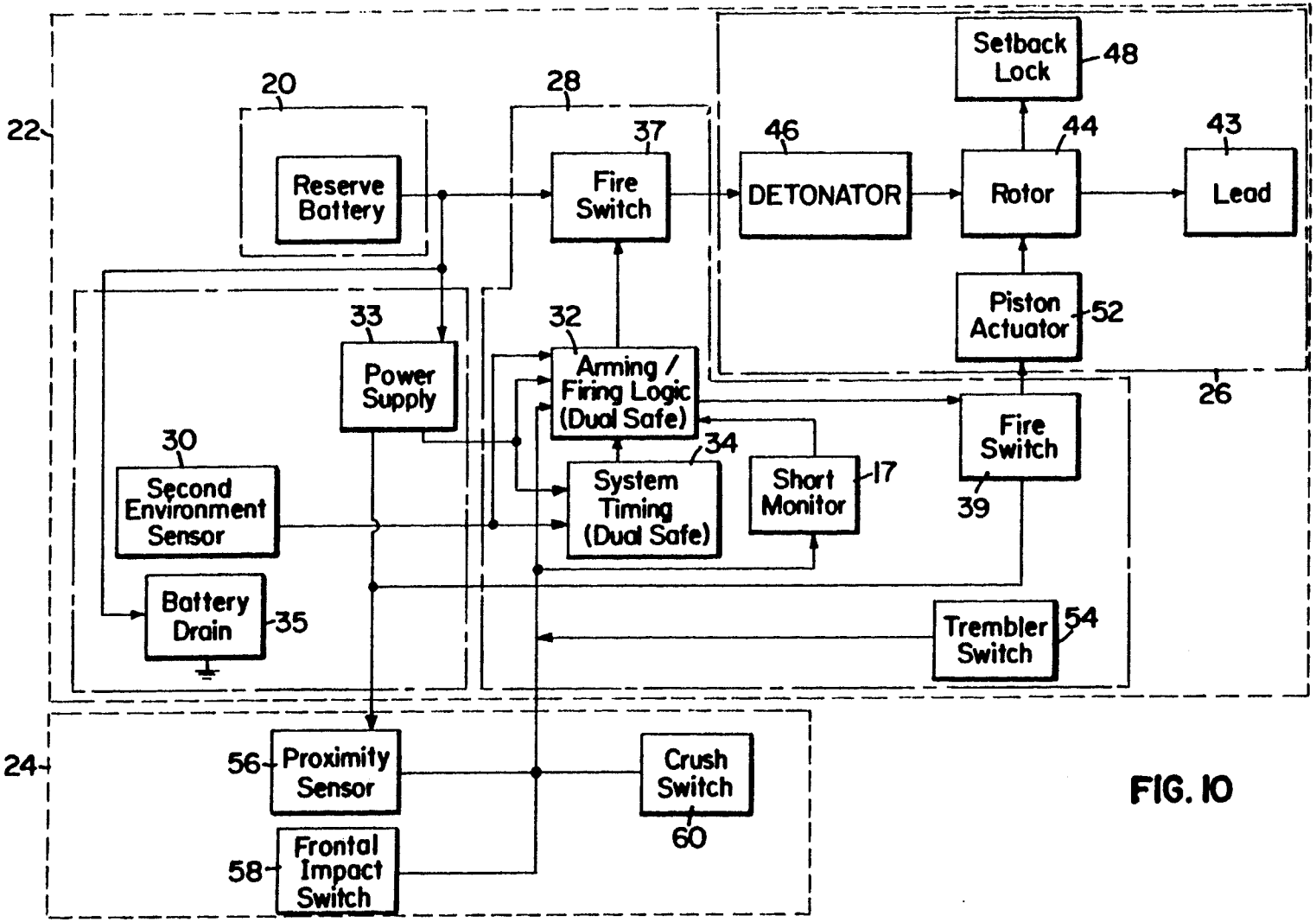
FIG. 10 is a block diagram of the base element fuze and related components in the nose cone.

Reference is now made to FIG. 10 which depicts the major subsystems of the preferred embodiment in block diagram form. The first two subsystems (battery assembly 20 and safe and arm assembly 26) have been discussed above and so will only be mentioned at this point. The battery assembly 20 is designed to be in reserve until use. The battery assembly 20 powers the fuze electronics located in the base 22 and the electronics located in the nose cone 24 of the projectile 15. The safe and arm (S&A) assembly 26 is the subject of a corresponding copending patent application which is assigned to the assignee of the present application. Such corresponding patent application is entitled "Gun Launched Non-Spinning Safety and Arming Mechanism", Ser. No. 07/901,113, filed on Jun. 19, 1992 by Paul L. Weber and Peter H. Van Sloan. Such application is hereby incorporated herein by reference. S&A assembly 26 provides means for arming and detonating the projectile 15.

The third major subassembly of the preferred embodiment is the electronics assembly 28. Electronics assembly 28 provides executive control of the fuze and preferably includes a second environment sensor 30, dual safe arming/firing logic 32 and system timing 34, a power supply 33 for conditioning and regulating the voltage from the battery assembly 20, a battery drain circuit 35 for draining the battery 20 in the event that the battery assembly 20 is activated, but the second environment event does not occur, fire switches 37 and 39 for firing the detonator 46 and piston actuator 52 respectively, and a short monitor 17 for monitoring the nose cone sensors to verify the signal path integrity before detonating.

The second environment sensor 30 is a safety related function. The sensor 30 detects the release of the sabots 64 after the projectile 15 has left the bore. The second environment sensor 30 is also the subject of a corresponding copending patent application commonly assigned to the assignee of the present application. Such corresponding application is titled "Magnetic Sensor Arming Apparatus and Method for an Explosive Projectile" Ser. No. 07/901,392, filed on Jun. 19,.1992 by Dennis L. Kurschner and Gregory F. Filo. Such application is hereby incorporated herein by reference.

Figure 11:
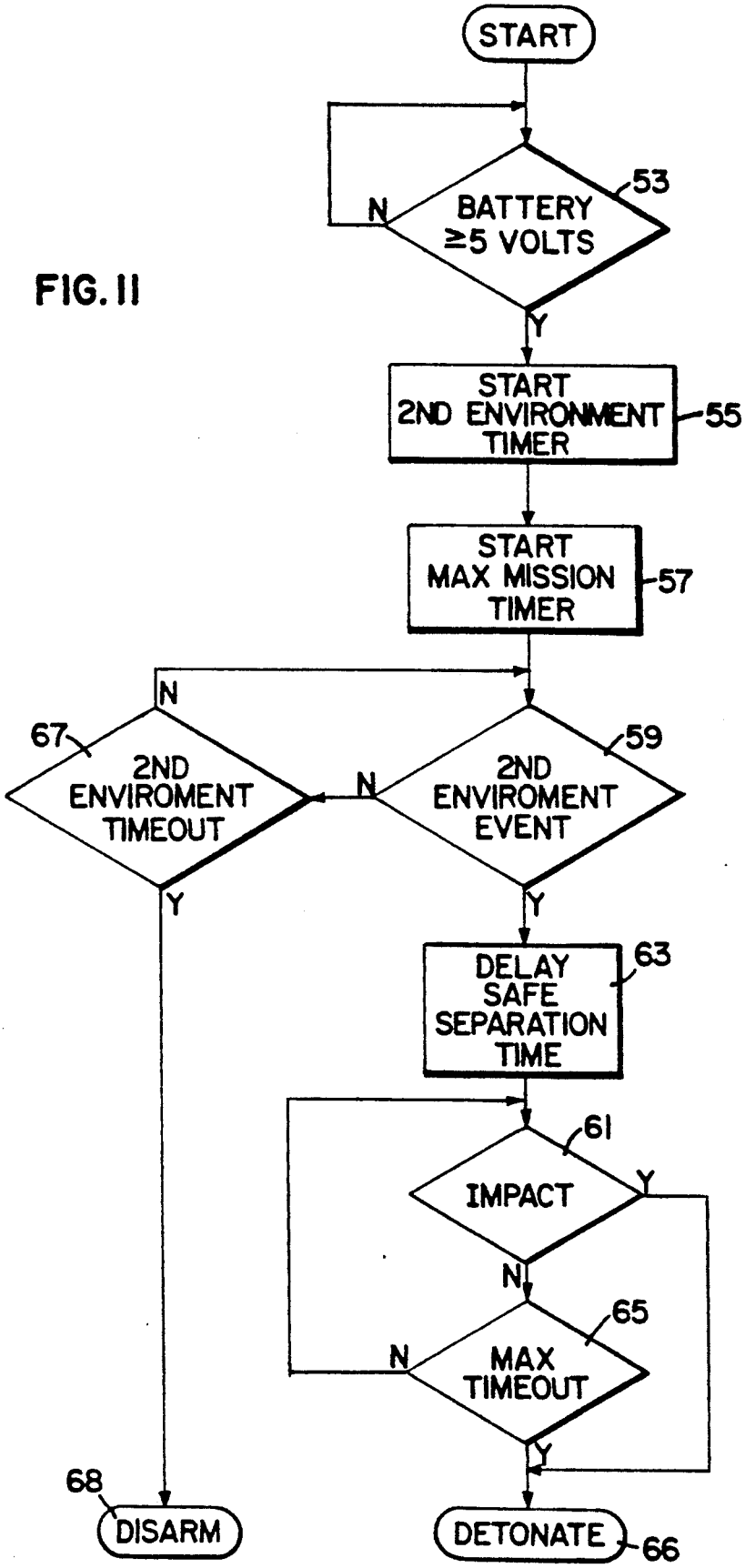
FIG. 11 is a flow diagram depicting the events leading up to detonation in the present invention.

Reference is now made to FIG. 11 in which a flow diagram depicting the events of the present invention is illustrated. At step 53, the battery voltage reaches 5 volts. At step 55, a timer is started to window the second environment event e.g., (sabot 64 release). At step 57, a self-destruct timer is initiated for a maximum mission timeout to detonate (at step 66) the detonator 46 and destroy the projectile 15 in the event the second environment sensor 30 is activated (sabot released) at step 59 and no target impact is detected at step 61 after a prescribed period of time at step 65. At step 63, a safe separation delay is inserted before allowing impact sensing. Otherwise at step 67 a second environment sensor timeout occurs and the projectile 15 is disarmed at step 68.

The nose cone 24 contains a proximity sensor 56, a frontal impact switch 58 for hard target impact and crush switch 60 for graze or high obliquity target impact. Detonation can be initiated by the trembler switch 54 being activated at 2,000–3,000 G's (side swipe or soft target impact), the frontal impact switch 58 being activated at 20,000–25,000 G's (a direct hit), the crush switch 60 being activated (oblique hit), or the proximity sensor 56 being activated (standoff attack).

Figure 12A:
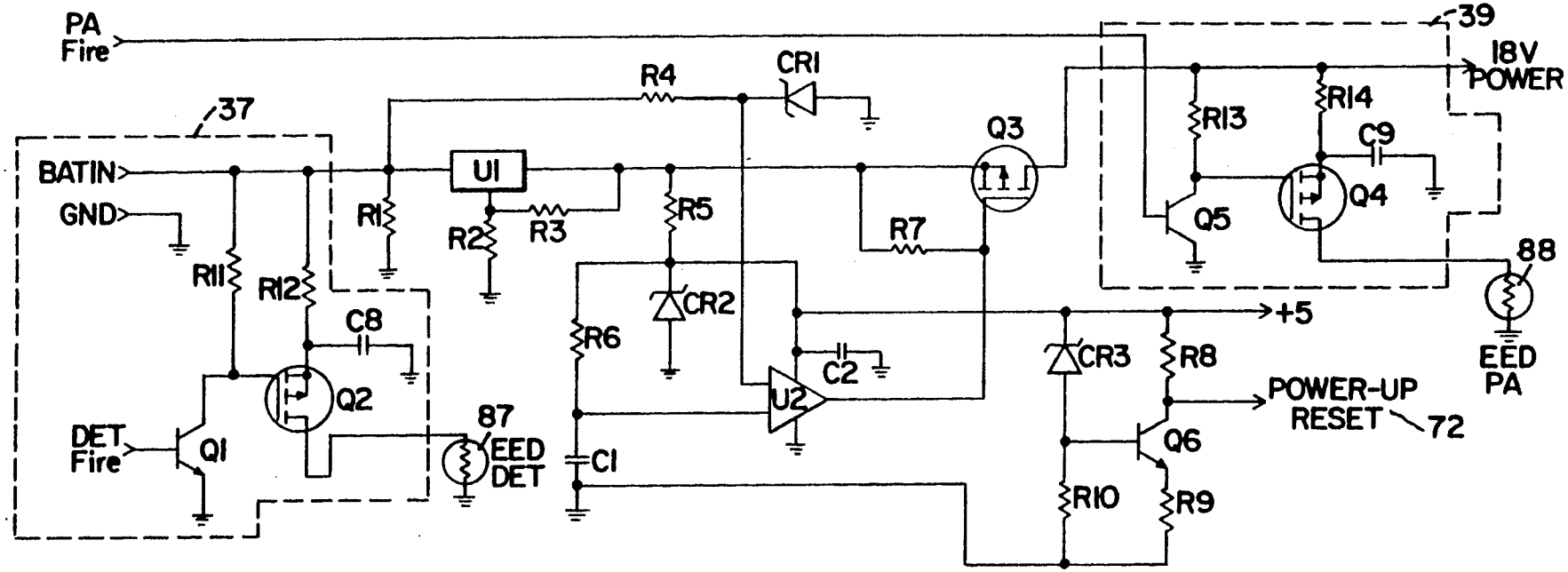
FIG. 12A, and 12B are schematic diagrams of the power and sensor electronics of the present invention.
Figure 12B:
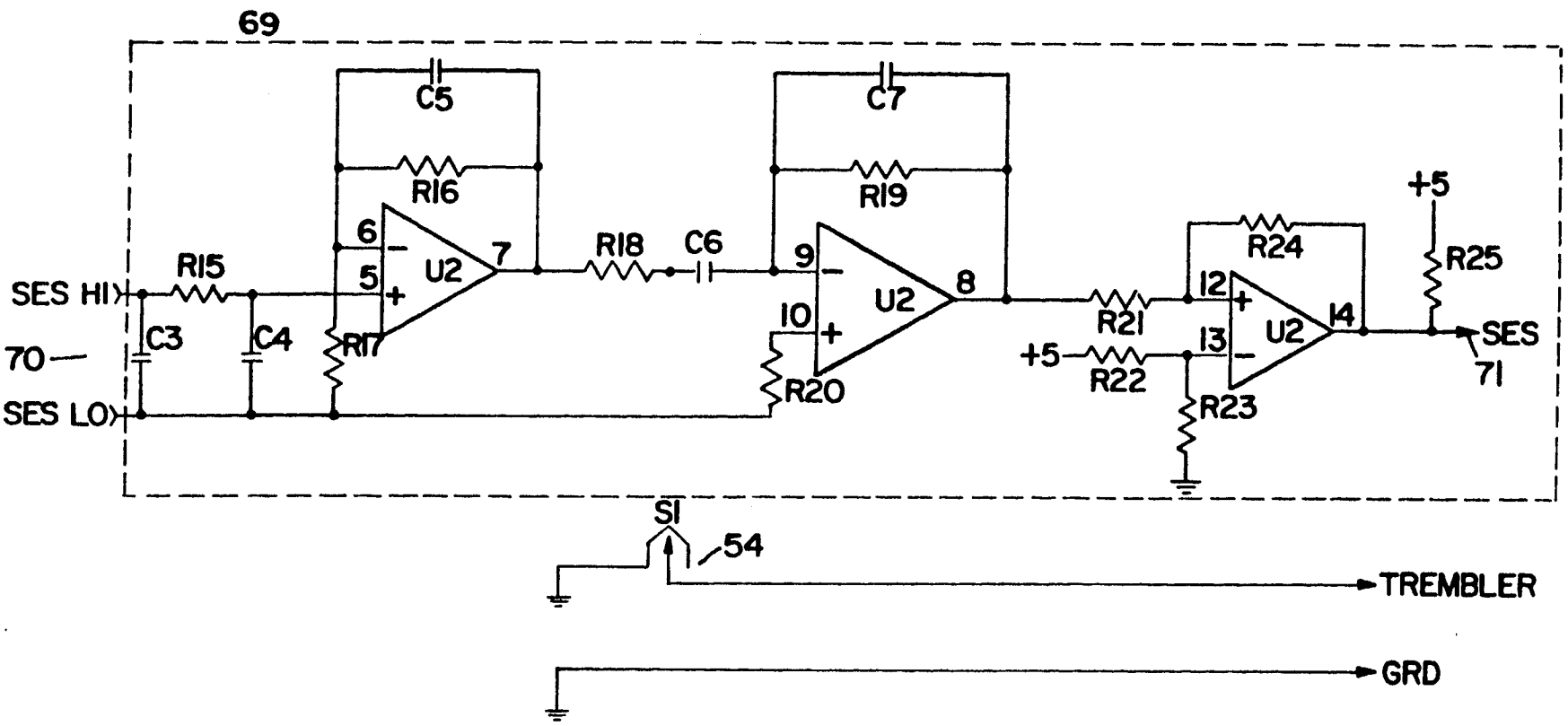

Reference is now made to FIGS. 12A and 12B which depict schematic diagram of the preferred embodiment of the power and sensor portions of the electronics assembly 28 of the present invention. Those skilled in the art will be able to bring to mind other suitable detailed circuitry for this and the circuitry detailed in FIG. 13 which depicts in detailed schematic diagram form, the timing and logic portions of the electronics assembly 28 of the present invention.

Circuitry 69 receives and conditions the input 70 from the second environment sensor. The single ended output 71 is routed to the timing and logic circuitry depicted in FIG. 13. Fire switches 37 and 39 are depicted as NPN transistors coupled to FET transistors for driving the squib devices 87, 88 respectively for the detonator 46 and piston actuator 52 respectively. Squib devices 87, 88 use joule heating due to a wire resistance to ignite an explosive packed about the device as is well known in the art. A power-up reset pulse is generated at output 72 for resetting the timing/logic circuit in FIG. 13.

Figure 13:
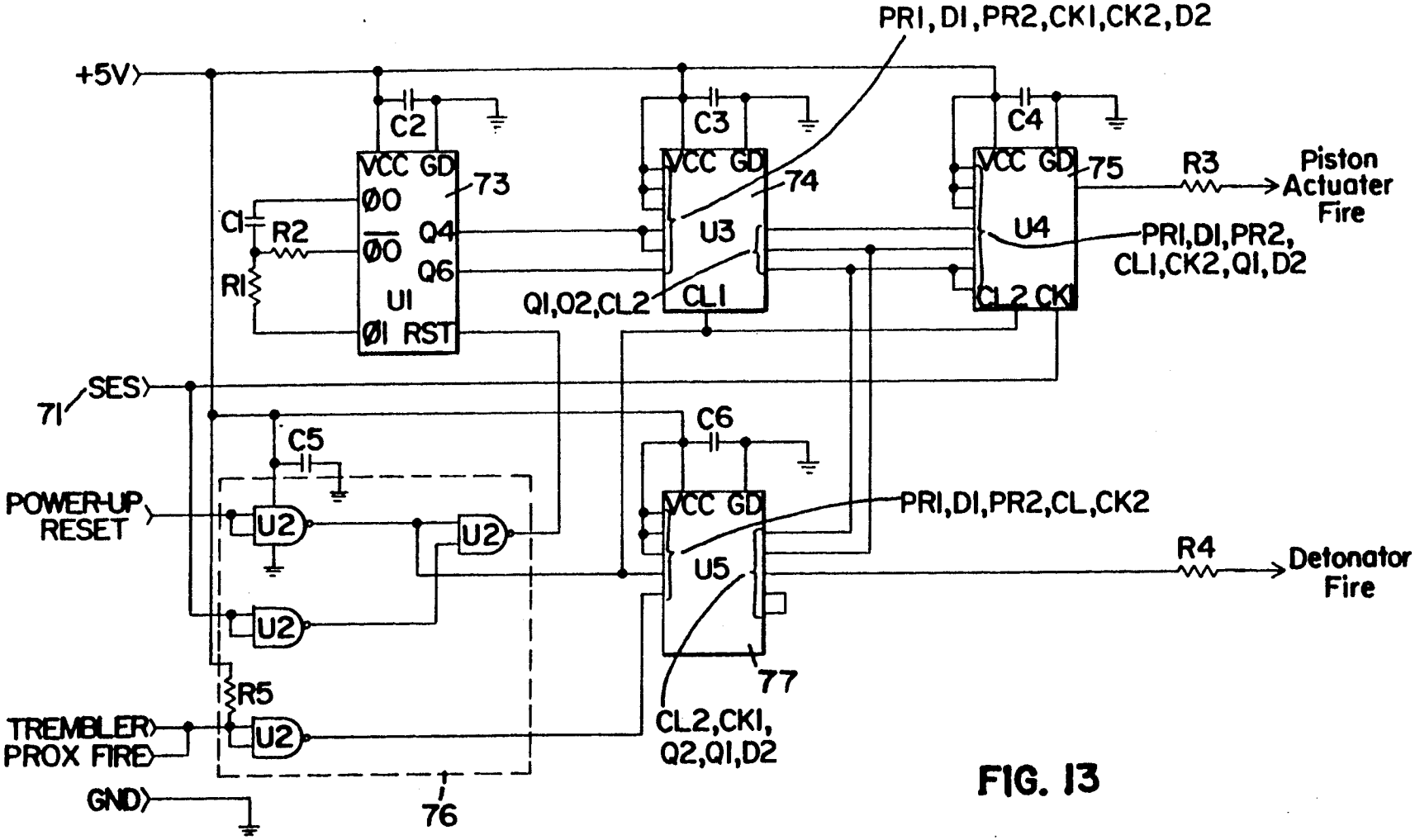
FIG. 13 is a schematic diagram of the timing and logic electronics of the present invention.

Reference is now made to FIG. 13. A 14-stage ripple carry binary counter 73 generates clock outputs on outputs Q. and $Q_6$ for driving flip-flop 74. Combination logic 76 having inputs coupled to the power-up reset 73, trembler switch 54 and proximity switch 56 provides a reset pulse to ICs 73 and 77. IC 75 is a flip-flop having a clock input coupled to the second environment sensor output 71 to enable the piston actuator firing circuit. IC 77 is a flip-flop with one clock input coupled to IC 74 to enable the detonator firing circuit at safe separation and the other clock input is coupled to the trembler switch 54 or the proximity switch 56 for generating a detonator signal for detonator 46.

The circuitry depicted in FIGS. 12A, 12B, and 13 implement the logical steps as depicted in flow diagram of FIG. 11.

The electronics use packaging of the industrial plastic package type in order to withstand the G-forces found in a tank environment while also being of a suitable size. It is believed that the internal bond wires of current ceramic type packages break during the high G-forces. Therefore, the plastic packages are preferred.

It will be appreciated that use of electronics is a design choice dependent upon the forces acting on the projectile 15. It will also be appreciated that use of integrated circuit electronics allows windows, timing, and logical conditions to be easily and rapidly varied without the drawbacks associated with mechanical timing devices. Therefore, various first and second environment devices might be utilized in combination with the electronics to provide firing conditions while the electronics can be suitably adjusted to compensate for such changes. Therefore, the modularity of the present invention will become immediately evident.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An electro-mechanical fuze in an explosive projectile launched from a gun tube, the fuze comprising:

(a) a reserve battery assembly disposed in a base cavity at a proximal end of the projectile, the battery assembly having:

(i) a reservoir, cooperatively connected to a distal end of the assembly and containing an electrolyte, the reservoir capable of being ruptured upon the application of a force thereto;

(ii) a mass slidably disposed adjacent the reservoir in a first static position and arranged and configured to deliver a force to the reservoir when the mass is accelerated by the launch from the gun tube; and (iii) a voltage producing cell stack generally surrounding the reservoir, wherein upon launch of the projectile, acceleration forces slide the mass to a second position and apply force to the reservoir such that the reservoir ruptures and the mass forces the electrolyte into the cell stack providing substantially instantaneous battery voltage;

(b) a safe and arm assembly, disposed adjacent the battery assembly, for providing an out-of-line safety between an explosive train and a detonator until at least one preselected condition occurs; and (c) an electronics assembly, operatively connected to receive power from the reserve battery assembly, for arming the fuze and initiating the explosive train when the at least one preselected condition occurs.

2. An electro-mechanical fuze as recited in claim 1, wherein the mass comprises inner and outer disk members slidably disposed adjacent the reservoir and arranged and configured to deliver a force to the reservoir when the inner and outer disk members are accelerated by the launch from the gun tube, wherein upon launch of the projectile, acceleration forces slide the inner and outer disk members to second positions, the second position of the inner disk being disposed substantially within the voltage producing cell stack.

3. An electro-mechanical fuze in an explosive projectile launched from a gun tube, the fuze comprising:

(a) a reserve battery assembly disposed in a base cavity at a proximal end of the projectile, the battery assembly having:

(i) a reservoir, cooperatively connected to a distal end of the assembly and containing an electrolyte, the reservoir capable of being ruptured upon the application of a force thereto;

(ii) a mass slidably disposed adjacent the reservoir in a first static position and arranged and configured to deliver a force to the reservoir when the mass is accelerated by the launch from the gun tube; and (iii) a voltage producing cell stack surrounding the reservoir, wherein upon launch of the projectile, acceleration forces slide the mass to a second position and apply force to the reservoir such that the reservoir ruptures and the electrolyte escapes into the cell stack providing substantially instantaneous battery voltage;

(b) a safe and arm assembly, disposed adjacent the battery assembly, for providing an out-of-line safety between an explosive train and a detonator until at least one preselected condition occurs; and (c) an electronics assembly, operatively connected to receive power from the reserve battery assembly, for arming the fuze and initiating the explosive train when the at least one preselected condition occurs, wherein the electronics assembly further comprises a second environment sensor for detecting a second environment occurrence.

4. An electro-mechanical fuze as recited in claim 3, wherein the explosive projectile is of the type having a sabot, and wherein the second environment sensor comprises means for detecting the release of the sabot after the projectile has exited the gun tube and has traveled a predetermined distance.

5. An electro-mechanical fuze as recited in claim 3, wherein the safe and arm assembly comprises:

(a) a rotor having a bore hole therethrough and a rotor impact surface thereon, the rotor having a first out-of-line position for impeding a path between the detonator and an explosive and a second in-line position defining an armed position;

(b) means, engageable with the rotor, for rotating the rotor about its axis and into the armed position;

(c) an in-bore lock wherein upon launch, the in-bore lock moves down to secure the rotor out-of-line while the projectile is within the gun tube, the in-bore lock removing the rotor impact surface from the means for rotating the rotor thus eliminating a possibility of in-bore arming of the projectile, and wherein once out of the gun tube, the in-bore lock releases and restored the rotor impact surface to the means for rotating the rotor; and (d) a setback lock for holding back the rotor wherein at maximum acceleration of the projectile, the setback lock swings in a downwardly direction to latch leaving only the in-bore lock holding the rotor.

6. An electro-mechanical fuze as recited in claim 5, wherein the means for rotating the rotor is an electrically activated piston actuator.

7. An electro-mechanical fuze as recited in claim 3, wherein the electronics assembly further comprises means for receiving detonation indication inputs and at least one switch assembly for indicating detonation.

8. An electro-mechanical fuze as recited in claim 2, wherein the at least one switch assembly comprises a trembler switch, a first, a second, and a third switch disposed at a distal end of the projectile.

9. A highly reliable fuze for precise control of arming time of a warhead with significantly low parts count and reduced cost, the fuze comprising:

(a) a reserve battery for powering all of the fuze subsystems, the battery activated upon launching of the warhead and having a rapid rise time to an operating voltage;

(b) a simplified mechanical safety and arming mechanism for providing an electro-mechanical out-of-line first environment safety;

(c) an electronic environment sensor for sensing the occurrence of a second environment event and for providing a second environment safety;

(b) electronic timing and control means for windowing a sequence of time critical events;

(d) a piston actuator for actuating the safety and arming mechanism by breaking a shear tab and arming a rotor in response to a predetermined occurrence of events; and (e) a setback lock for inhibiting the rotor movement given inadvertent piston actuator firing.

10. An electro-mechanical fuze as recited in claim 9, wherein the warhead is a 120 millimeter projectile.

11. A fuze as recited in claim 9, wherein the reserve battery, the safety and arming mechanism and electronic timing and control means employ a modular profile for accommodating existing and future precision armaments.

12. An electro-mechanical fuze as recited in claim 9, further comprising:

(a) means for providing at least two independent safety features for preventing premature arming of a warhead;

(b) means for responding to hard target detection;

(c) means for responding to proximity sensing;

(d) means for providing soft target impact detection;

(e) means for providing safe separation from the launcher prior to arming the fuze.

13. A base element fuze system as recited in claim 12 wherein the system further comprises a mode select for selecting between ground and air attacks.

14. In an explosive projectile, a method for arming an electro-mechanical fuze, comprising the steps of:

(a) accelerating the projectile for launching;

(b) thrusting a mass against a reservoir containing an electrolyte in response to step (a);

(c) rupturing the reservoir allowing the electrolyte to escape into a battery cell stack for providing substantially instantaneous voltage; and (d) rotating a rotor for providing an in-line site between a detonator and an explosive.

15. A method for igniting an electro-mechanical fuze as recited in claim 14, further comprising the steps of:

(a) starting a first timer when the battery voltage initially reaches five volts to window a sabot release event;

(b) starting a second timer for generating a safe separation distance in response to the first timer reaching a predetermined time; and (c) firing a piston actuator to rotate the rotor inline;

(d) detonating the warhead in response to activation of one of a group of a trembler switch, a frontal impact switch, a crush switch, and proximity sensor.

16. A method for igniting an electro-mechanical fuze as recited in claim 15, wherein the trembler switch is activated in response to a sideswipe of the projectile.

17. A method for igniting an electro-mechanical fuze as recited in claim 15, wherein the trembler switch is activated in response to the projectile impacting a soft target.

18. A method for igniting an electro-mechanical fuze as recited in claim 15, wherein the frontal impact switch is activated in response to the projectile directly hitting a target.

19. A method for igniting an electro-mechanical fuze as recited in claim 15, wherein the crush switch is activated in response to the projectile obliquely impacting a target.

20. A method for igniting an electro-mechanical fuze as recited in claim 15, wherein the proximity sensor is activated in response to sensing an attacking warhead to standoff attacks.

21. An electro-mechanical fuze in an explosive projectile launched from a gun tube, the fuze comprising:

(a) a reserve battery assembly disposed in a base cavity at a proximal end of the projectile the base cavity defining a first volume, the battery assembly including:

(i) a voltage producing cell stack disposed within the first volume and defining a second volume within a portion of the first volume, wherein the cell stack generally surrounds the second volume;

(ii) a reservoir, substantially disposed within the second volume and extending into the first volume, the reservoir containing an electrolyte and capable of being ruptured upon the application of a force thereto; and (iii) first and second masses slidably disposed adjacent the reservoir in first static positions and arranged and configured to deliver a force to the reservoir, wherein the second mass is arranged and configured to be slidably disposed with the first mass, and wherein when the first and second masses are accelerated by the launch from the gun tube, the first mass is accelerated to a second operative position within the first volume adjacent the cell stack and the second mass is accelerated to a second operative position within the second volume defined by the cell stack, thereby applying a force to the reservoir and effectively decreasing the first volume by movement from the first static positions to the second operative positions, whereby the reservoir ruptures and the electrolyte is forced into the cell stack, providing substantially instantaneous battery voltage;

(b) a safe and arm assembly, disposed adjacent the battery assembly, for providing an out-of-line safety between an explosive train and a detonator until at least one preselected condition occurs; and (c) an electronics assembly, operatively connected to receive power from the battery assembly, for arming the fuze and initiating the explosive train when the at least one preselected condition occurs.

* * * * *